US005435287A

United States Patent [19]

Mukai

[11] Patent Number: 5,435,287

[45] Date of Patent: Jul. 25, 1995

[54] EVAPORATING FUEL CONTROL APPARATUS FOR INTERNAL COMBUSTION ENGINE

[75] Inventor: Takeshi Mukai, Shizuoka, Japan

[73] Assignee: Suzuki Motor Corporation, Shizuoka, Japan

[21] Appl. No.: 268,626

[22] Filed: Jun. 30, 1994

[30] Foreign Application Priority Data

Sep. 30, 1993 [JP] Japan ..... 5-268007

[51] Int. Cl.[6] ..... F02M 37/04

[52] U.S. Cl. ..... 123/520; 123/516

[58] Field of Search ..... 123/198 D, 516, 518, 123/519, 520, 521

[56] References Cited

U.S. PATENT DOCUMENTS

| | | | |
|---|---|---|---|
| 4,862,856 | 9/1989 | Yokoe | 123/520 |
| 5,056,493 | 10/1991 | Holzer | 123/520 |
| 5,099,880 | 3/1992 | Szlaga | 123/519 |
| 5,172,672 | 12/1992 | Harada | 123/519 |
| 5,174,265 | 12/1992 | Sekine | 123/520 |
| 5,193,512 | 3/1993 | Steinbrenner | 123/520 |
| 5,295,472 | 3/1994 | Otsuka | 123/520 |
| 5,297,527 | 3/1994 | Suzuki | 123/520 |
| 5,347,971 | 9/1994 | Kobayashi | 123/520 |

FOREIGN PATENT DOCUMENTS

| | | | |
|---|---|---|---|
| 4-362264 | 12/1992 | Japan . | |
| 5180103 | 7/1993 | Japan | 123/519 |

*Primary Examiner*—Carl S. Miller

*Attorney, Agent, or Firm*—Flynn, Thiel, Boutell & Tanis

[57] ABSTRACT

An evaporating fuel control apparatus for an internal combustion engine including a canister placed midway of an air passageway for intercommunicating the inside of a fuel tank and an air inlet passageway of an air inlet system of the internal combustion engine and adapted to absorbingly hold evaporated fuel as generated in the fuel tank during stopping of the internal combustion engine, and purging such held evaporated fuel by introduction of fresh air so as to be supplied to the air inlet passageway during the operation of the internal combustion engine. A purge valve is placed midway of the air passageway between the canister and the air inlet passageway and is adapted to control the amount of evaporated fuel supplied to the air inlet passageway depending on the operating condition of the internal combustion engine. An air cut valve controls the feeding and stopping of the supply of air to the canister. A two-way cut valve is adapted to prevent the internal pressure of the fuel tank from becoming abnormal when the air cut valve is closed due to a failure.

2 Claims, 3 Drawing Sheets

EVAPORATING FUEL CONTROL APPARATUS FOR INTERNAL COMBUSTION ENGINE

FIELD OF THE INVENTION

This invention relates to an evaporating fuel control apparatus for an internal combustion engine, and particularly to an evaporating fuel control apparatus for an internal combustion engine capable of preventing the pressure in a fuel tank from becoming abnormal when an air cut valve is subjected to a failure.

BACKGROUND OF THE INVENTION

The evaporating fuel of vehicles, which often leaks into the air from a fuel tank and a float chamber of a carburetor, contains a large amount of hydrocarbon (HC), which is regarded as one of the causes of air pollution and which often results in waste of fuel. Various techniques are known as means for preventing this occurrence. As a typical technique, there is known an evaporating fuel control apparatus (i.e. an evaporation system) in which, during the operation of the internal combustion engine, evaporative fuel generated in the fuel tank is purged in a canister containing an absorbent such as activated carbon so as to be supplied to the internal combustion engine.

As shown in FIG. 5, this known evaporating fuel control apparatus comprises an air passageway 112 for communicating the inside of a surge tank 108, which is part of an air inlet passageway 106 on the downstream side of a throttle valve 104 in an air inlet system, with a fuel tank 110. A canister 114 is placed midway of the air passageway 112. This canister 114 is adapted to absorbingly hold the evaporating fuel generated in the fuel tank 110 during stopping of the internal combustion engine 102, and purging such held evaporating fuel by the introduction of fresh air during the operation of the internal combustion engine 2. With this feature, the air passageway 112 is divided into an evaporation passageway 116 between the fuel tank 110 and the canister 114, and a purge passageway 118 between the canister 114 and the air inlet passageway 106.

Midway of the evaporation passageway 116, there are provided a pressure sensor 122 through a detecting pressure introduction passageway 120 and a pressure control valve (TPCV) 124 arranged in this order from the fuel tank side. A purge valve (duty solenoid valve) 126 is placed in the purge passageway 118.

One end of a pressure passageway 128 is connected to the pressure control valve 124. The other end of the pressure passageway 128 is in communication with the inside of the surge tank 108. A three-way cut valve 130 is positioned midway of the pressure passageway 128.

One end of an air introduction passageway 132 is connected to the canister 114, and the other end is in communication with an air cleaner 134. Midway of the air introduction passageway 132, there is provided an air cut valve 136 adapted to cut the supply of the air to the canister 114.

The pressure sensor 122, the purge valve 126 and the air cut valve 136 are in communication with a control means 138.

With this feature, in order to check whether or not the apparatus is in a normal working condition, in the evaporating fuel control apparatus of FIG. 5, as shown in FIG. 6, during the operation of the internal combustion engine 102 a negative pressure temporarily acts on the whole air passageway 112 including the fuel tank 110 and thereafter the purge valve 126 and air cut valve 136 are maintained in their closed positions, thereby cutting the communication between the air and all the passageways. Then, the variation level of the negative pressure held by the whole air passageway 112 is detected. That is, it is judged whether or not air-tightness, etc. are maintained, such as, there being a leak when the rising of pressure is rapid, for example.

A failure checking apparatus of an evaporating fuel control apparatus of the type mentioned above is disclosed, for example, in Japanese Laid-Open Patent Application No. Hei 4-362264. The apparatus disclosed in this Laid-Open Publication carries out the detection of a failure as follows. Immediately after the start of the internal combustion engine and when the temperature of the engine is equal to or lower than a predetermined level, a failure checking valve is opened or closed and a purging control valve is opened to introduce a negative pressure in an air inlet tube, and then the purging control valve is opened and maintained in that condition for a predetermined time period, so that a failure can be checked with reference to the variation of the pressure level within the predetermined time period. In this way, it is not only a large amount of leakage of vapor from the whole evaporation purge system including the purge passageway but also a small amount of leakage of vapor, that can be detected without a misjudgment.

However, in the above known evaporating fuel control apparatus, when the air cut valve 136 as placed in the air introduction passageway between the canister 114 and air cleaner 134 is accidentally closed, a negative pressure acts directly on the inside of the fuel tank 110 through the purge valve 126 during the operation of the internal combustion engine. The result is a possibility that the fuel in the fuel tank is drawn directly to the inlet system through the air passageway, depending on the amount of the negative pressure. There is another possibility that when there is a predetermined condition for closing the purge valve, the fuel tank is hermetically closed and in addition, the evaporating fuel in the canister is not purged. In such a case, the pressure in the fuel tank becomes abnormal with the results that the operating efficiency is deteriorated and the evaporating fuel is sometimes leaked outside. Therefore, improvements are demanded.

Therefore, according to a first aspect of the present invention, in order to obviate the above-mentioned inconveniences, there is provided an evaporating fuel control apparatus for an internal combustion engine comprising a canister place midway of an air passageway for intercommunicating the inside of a fuel tank and an air inlet passageway of an air inlet system of the internal combustion engine and adapted to absorbingly hold evaporated fuel as generated in the fuel tank during stopping of the internal combustion engine, and purging such held evaporated fuel by introduction of fresh air so as to be supplied to the air inlet passageway during the operation of the internal combustion engine, a purge valve placed midway of the air passageway between the canister and the air inlet passageway and adapted to control the amount of evaporated fuel supplied to the air inlet passageway depending on the operating condition of the internal combustion engine, and an air cut valve for feeding and stopping the supply of air to the canister; the evaporating fuel control apparatus further comprising a two-way cut valve adapted to prevent the internal pressure of the fuel tank from becoming abnormal when the air cut valve is closed due to a failure.

According to a second aspect of the invention, the evaporating fuel control apparatus for an internal combustion engine, as aforesaid, further comprises an air communication passageway connected midway of the air passageway between the canister and the purge valve, and the two-way cut valve is placed midway of the air communication passageway.

According to a third aspect of the invention, the evaporating fuel control apparatus for an internal combustion engine, as aforesaid, further comprises an air communication passageway connected midway of an air introduction passageway between the canister and the air cut valve, and the two-way cut valve is placed in the air communication passageway.

According to a fourth aspect of the invention, said evaporating fuel control apparatus for an internal combustion engine, as aforesaid, further comprises the two-way cut valve including a positive pressure check valve and a negative pressure check valve, mounted on a cap of said fuel tank and adapted to maintain a predetermined level of internal pressure in said fuel tank.

According to the construction of the present invention, in case there is a possibility that the pressure in the fuel tank becomes abnormal due to the air cut valve being subjected to a failure by one reason or another, the two-way cut valve is actuated to introduce the air to maintain the predetermined level of pressure in the fuel tank. Accordingly, the fuel in the fuel tank is prevented from being supplied directly to the air inlet passageway through the air passageway so that the operating efficiency can be improved, and the evaporating fuel can be prevented from leaking outside.

DETAILED DESCRIPTION

Figure 1:
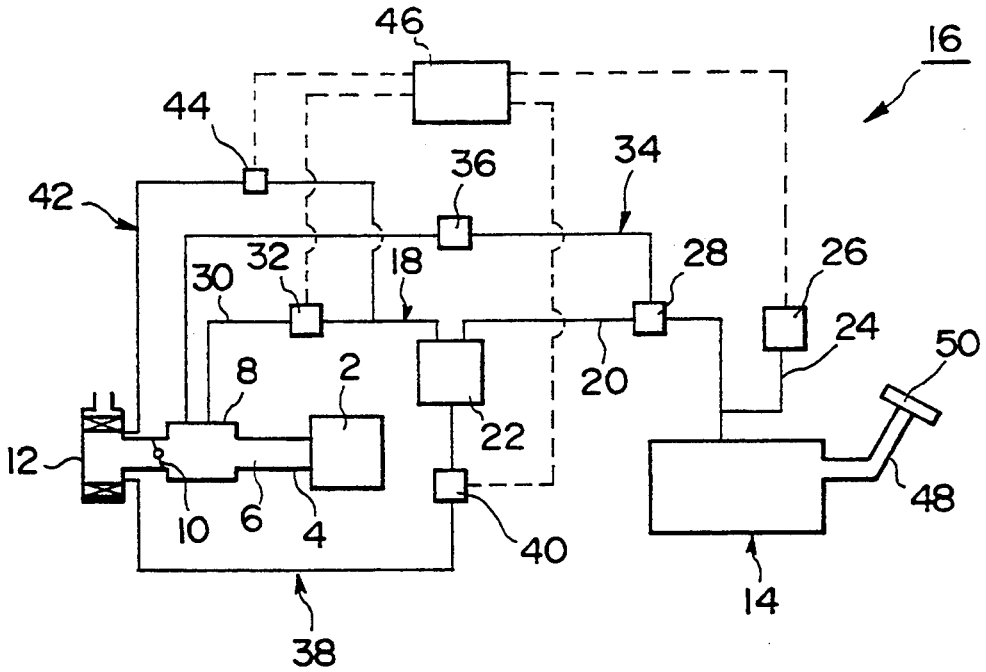
FIG. 1 is a block diagram of the system of an evaporating fuel control apparatus according to a first embodiment of the invention.

Embodiments of the present invention will be described in detail and specifically with reference to the drawings. FIG. 1 shows a first embodiment of the present invention.

In FIG. 1, reference numeral 2 denotes an internal combustion engine; 4 an inlet manifold; 6 an air inlet passageway; 8 a surge tank; 10 a throttle valve; 12 an air cleaner; and 14 a fuel tank. Between the fuel tank 14 and an air inlet system of the internal combustion engine 2, there is provided an evaporating fuel control apparatus (evaporation system) 16.

Specifically, there is provided an air passageway 18 between the fuel tank 14 and the surge tank 8 of the air inlet system.

One end of an evaporation passageway 20 constituting a part of the air passageway 18 is in communication with the inside of the fuel tank 14, while the other end thereof is opened to the upper inside of a canister 22. The evaporation passageway 20 is provided with a pressure sensor 26 through a detecting pressure introduction passageway 24 and a pressure control valve 28 arranged in this order from the fuel tank 14 side.

One end of a purge passageway 30 constituting a part of the air passageway 18 is opened to the upper inside of the canister 22 in parallel to the evaporation passageway 20, while the other end thereof is in communication with the inside of the surge tank 8 on the downstream side of the throttle valve 10.

The canister 32 contains an absorbent such as activated carbon for absorbingly holding the evaporated fuel from the fuel tank 14, and purges such held evaporated fuel by fresh air being introduced through an air introduction passageway 38 so as to flow toward the purge passageway 30 side.

A purge valve (duty solenoid valve) 32 is inserted midway of the purge passageway 30. The purge valve 32 is adapted to communicate/discommunicate the purge passageway 30 and control the amount of evaporated fuel (purging amount) from the canister 32.

One end of a pressure passageway 34 is connected to the pressure control valve 28. The other end of the pressure passageway 34 is in communication with the inside of the surge tank 8. A three-way cut valve 36 is provided midway of the pressure passageway 34.

One end of the air introduction passageway 38 is connected to a lower portion of the canister 22. The other end of the air introduction passageway 38 is in communication with the air cleaner 12. The other end of this air introduction passageway 38 may serve as an opening to the air. Midway of the air introduction passageway 38, there is provided an air cut valve 40 for supplying or cutting the supply of air to the canister 22.

One end of an air communication passageway 42 is connected midway of the purge passageway 30 between the canister 22 and the purge valve 32. The other end of the air communication passageway 42 is in communication, for example, with the air cleaner 12. The other end of the air communication passageway 42 may serve as an opening to the air.

A two-way cut valve 44 is provided midway of the air communication passageway 42. This two-way cut valve 44 is in communication with a control means 46 and normally is in a closed position. But when supplied with an electric current, the two-way cut valve 44 is maintained in its open position.

The control means 46 is in communication with the pressure sensor 26, the purge valve 32 and the air cut valve 40.

A tank cap 50 is attached to the fuel tank 14 through a fuel supply tube 48.

Next, the operation of the FIG. 1 embodiment will be described.

The evaporated fuel generated in the fuel tank 14 is introduced to the canister 22 through the evaporation passageway 20 and absorbingly held by the canister 22 during the stopping of the internal combustion engine 2.

The evaporated fuel held by the canister 22 is purged by the fresh air introduced through the air introduction passageway 38 during the operation of the internal combustion engine 2 and supplied to the air inlet passageway 6 through the purge passageway 30. This purging amount of the evaporated fuel is controlled by the purge valve 32.

In the event the air cut valve 40 is subjected to a failure by one reason or another during the operation of the internal combustion engine 2 so that the air cut valve 40 is maintained in its closed position, in other words, the air cut valve 40 is in an energized condition, the pressure in the air passageway 18 is liable to rise. However, since the two-way cut valve 44 placed in the air communication passageway 42 is actuated and opened by the control means 46, air can be introduced into the purge passageway 30 so that the pressure in the air passageway 18 and fuel tank 14 will not become abnormal, such as too low or too high.

With the above features, the fuel can be prevented from being supplied directly from the fuel tank 14 to the air inlet passageway 6 to improve the operating efficiency. Moreover, the pressure in the evaporating fuel control apparatus 16 does not become abnormal. Therefore, the evaporated fuel can be avoided from leaking outside and HC can be prevented from being released to the air.

Figure 2:
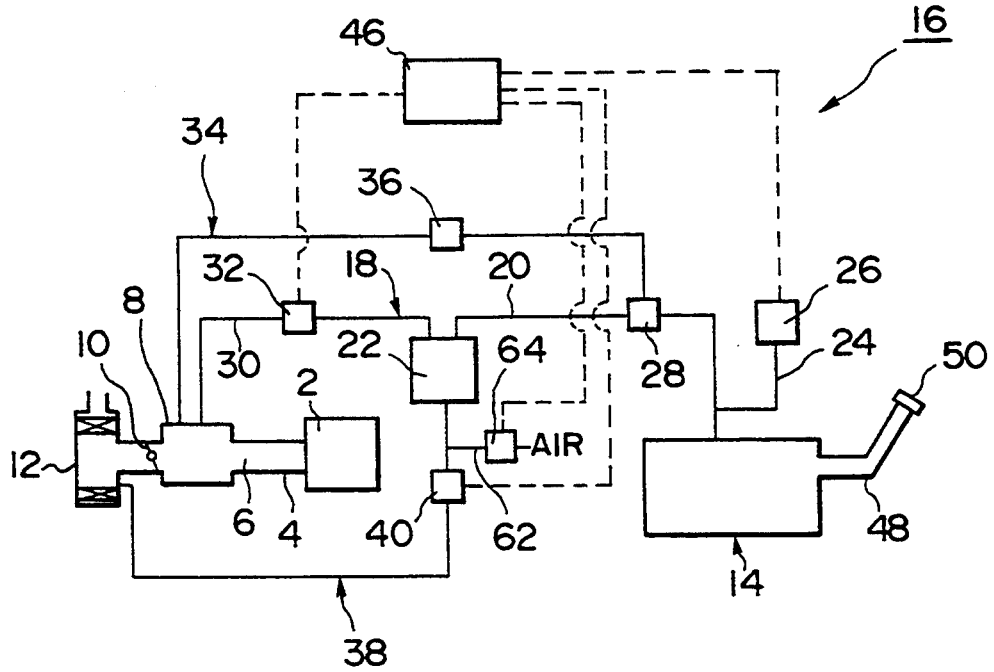
FIG. 2 is a block diagram of the system of an evaporating fuel control apparatus according to a second embodiment.

FIG. 2 shows a second embodiment of the present invention.

In the embodiments to be described hereinafter, those parts having like functions of the first embodiment are denoted by like reference numerals.

The features of this second embodiment are that one end of an air communication passageway 62 is connected midway of the air introduction passageway 38 between the canister 22 and the air cut valve 40, and a two-way cut valve 64 is placed in this air communication passageway 62.

According to this second embodiment, in the event the air cut valve 40 is maintained accidentally in its closed position by one reason or another during the operation of the internal combustion engine 2, the two-way control valve 64 is activated to introduce air into the canister 22 through the air communication passageway 62. Accordingly, the pressure in the canister 22 and fuel tank 14 can be prevented from becoming abnormal.

With this feature, the fuel can be prevented from being supplied directly from the fuel tank 14 to the air inlet passageway 6 thereby to improve the operating efficiency. Moreover, the pressure in the evaporating fuel control apparatus 16 does not become abnormal and the evaporating fuel can be prevented from leaking outside.

Figure 3:
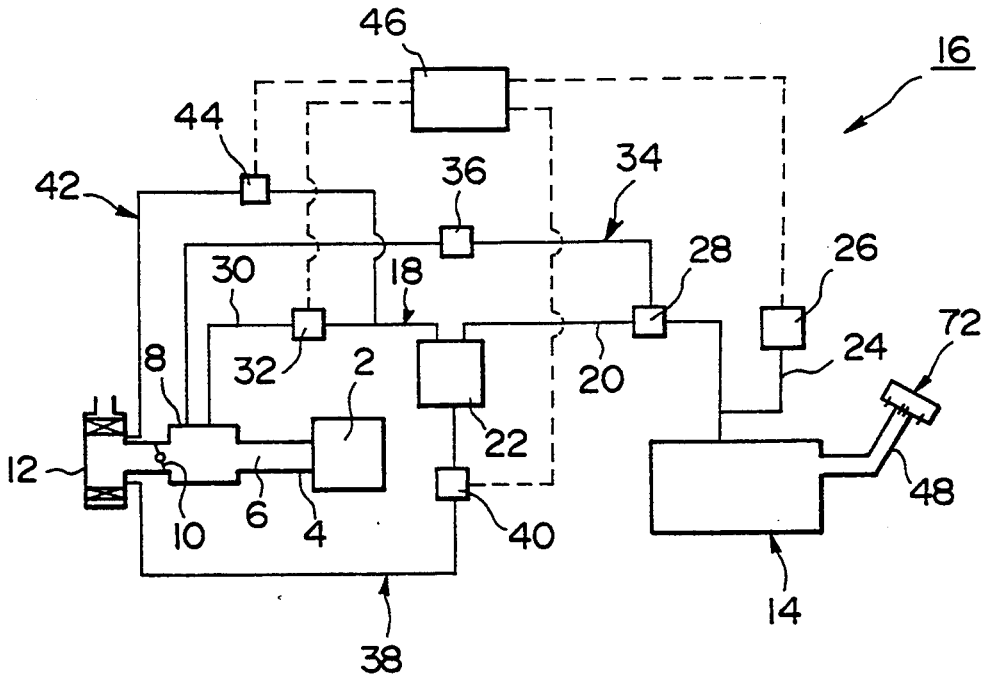
FIG. 3 is a block diagram of the system of an evaporating fuel control apparatus according to a third embodiment.
Figure 4:
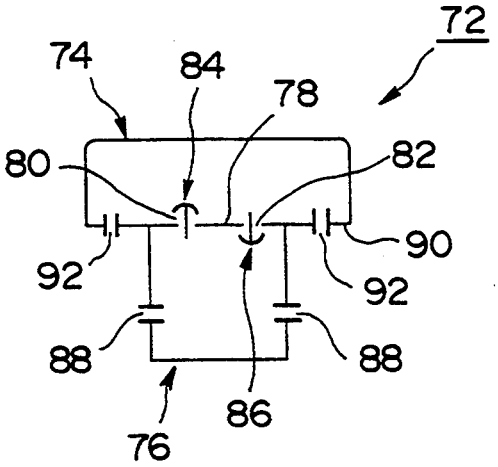
FIG. 4 is a block diagram of a tank cap according to the third embodiment.
Figure 5:
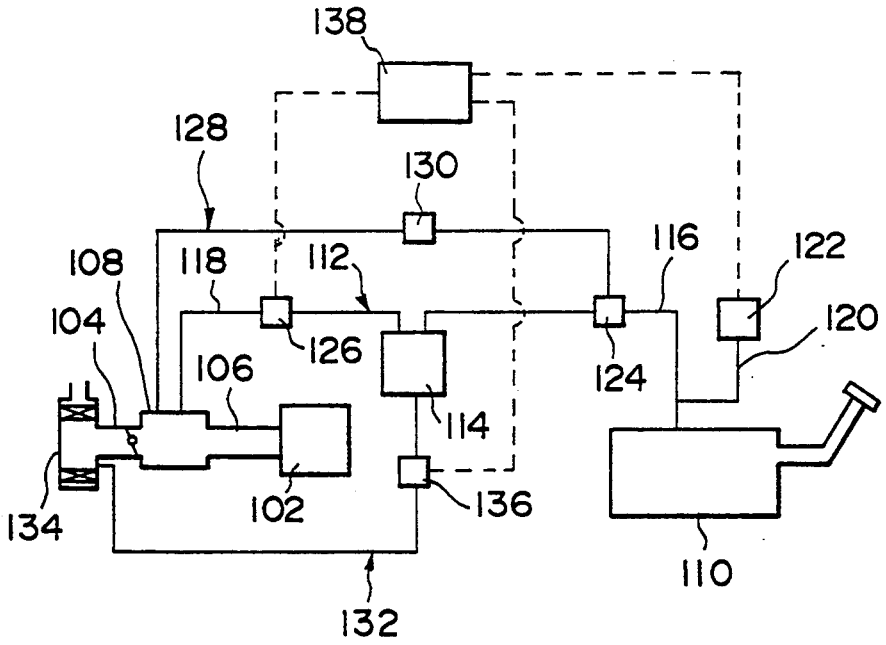
FIG. 5 is a block diagram of the system of an evaporating fuel control apparatus according to the prior art.
Figure 6:
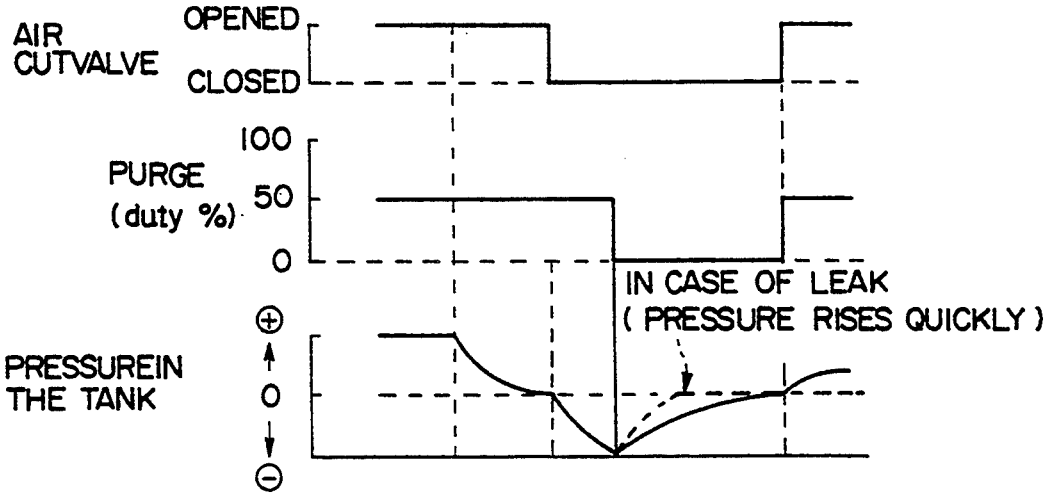
FIG. 6 is a time chart for determining failure of the evaporating fuel control apparatus.

FIGS. 3 and 4 illustrate a third embodiment of the present invention.

The features of this third embodiment are as follows. A tank cap 72 attached to the fuel supply tube 48 of the fuel tank 14 consists of a hollow cap portion 74 and a hollow mounting portion 76, a partition plate 78 being provided between the cap portion 74 and the mounting portion 76, the partition plate 78 being formed with a first-side valve bore 80 and an opposite second-side valve bore 82, a positive pressure check valve 84 being placed in the first-side valve bore 80 whereas a negative pressure check valve 86 being placed in the second-side valve bore 82 so as to act as the two-way cut valve, an inner flow passageway 88 being formed in an outer peripheral part of the mounting portion 76 whereas an outer flow passageway 92 being formed in an outer edge member 90 of the cap portion 74.

According to the construction of this third embodiment, when the pressure in the fuel tank 14 becomes abnormal, the positive pressure check valve 84 and the negative pressure check valve 86 are activated to adequately introduce air into the fuel tank 14 so that a predetermined level of pressure can be maintained in the fuel tank 14.

In the first and second embodiments, the two-way cut valves 44 and 64 are actuated by the control means 46. Alternatively, an arrangement can be employed in which the two-way cut valves 44 and 64 are activated depending on the pressure level of the air passageway 18.

As apparent from the foregoing description, according to the present invention, owing to a provision of a two-way cut valve for preventing the pressure in the fuel tank from becoming abnormal when the air cut valve is closed because of failure, the two-way cut valve is actuated, when the pressure in the fuel tank is likely to become abnormal, to introduce air into the fuel tank so that the predetermined level of the pressure is maintained in the fuel tank. With this feature, the fuel in the fuel tank is prevented from being supplied directly to the air inlet passageway, the operating efficiency is improved, and the evaporating fuel can be prevented from leaking outside.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an evaporating fuel control apparatus for an internal combustion engine including a canister disposed along and in communication with an air passageway for intercommunicating the inside of a fuel tank and an air inlet passageway of an air inlet system of the internal combustion engine and adapted to absorbingly hold evaporated fuel as generated in said fuel tank during stopping of the internal combustion engine and be purged of said evaporated fuel by introduction of fresh air thereto so that said evaporated fuel being purged is supplied to said air inlet passageway during the operation of the internal combustion engine, a purge valve disposed in communication with said air passageway between said canister and said air inlet passageway and adapted to control the amount of evaporated fuel supplied to said air inlet passageway depending on the operating condition of the internal combustion engine, and an air cut valve for feeding and stopping the supply of said fresh air to said canister, the improvement comprising a two-way cut valve adapted to prevent the internal pressure of said fuel tank from becoming abnormal when said air cut valve is closed due to a failure, the two-way cut valve including a positive pressure check valve and a negative pressure check valve, both mounted on a cap of the fuel tank and adapted to maintain a predetermined level of internal pressure in said fuel tank.

2. An evaporating fuel control apparatus according to claim 1, wherein an air communication passageway is connected midway of said air passageway between said canister and said purge valve, and a two-way cut valve is placed in communication with said air communication passageway for controlling flow therethrough.

* * * * *